US008684199B2

(12) United States Patent
Jiang et al.

(10) Patent No.: US 8,684,199 B2
(45) Date of Patent: Apr. 1, 2014

(54) COUPLER YOKE AND COUPLER DRAFT GEAR

(75) Inventors: Yan Jiang, Qiqihar (CN); Yingjun Cui, Qiqihar (CN); Shengguo Cong, Qiqihar (CN); Qingmin Meng, Qiqihar (CN)

(73) Assignee: Qiqihar Railway Rolling Stock Co., Ltd., Qiqihar (CN)

( * ) Notice: Subject to any disclaimer, the term of this patent is extended or adjusted under 35 U.S.C. 154(b) by 0 days.

(21) Appl. No.: 13/570,117

(22) Filed: Aug. 8, 2012

(65) Prior Publication Data

US 2012/0298610 A1 Nov. 29, 2012

Related U.S. Application Data

(63) Continuation of application No. PCT/CN2011/074764, filed on May 27, 2011.

(30) Foreign Application Priority Data

Apr. 1, 2011 (CN) ..... 2011 1 0082265

(51) Int. Cl.
*B61G 9/22* (2006.01)

(52) U.S. Cl.
USPC ..... 213/67 R; 213/67 A

(58) Field of Classification Search
USPC ..... 213/67 R, 67 A, 68–72
See application file for complete search history.

(56) References Cited

U.S. PATENT DOCUMENTS 1,488,158 A * 3/1924 Kadel ..... 213/67 A
1,557,060 A * 10/1925 Kadel ..... 213/67 A
1,611,292 A * 12/1926 Sullivan ..... 213/70
1,687,163 A * 10/1928 Kadel ..... 213/69
3,856,153 A * 12/1974 Cope ..... 213/67 A
4,635,804 A * 1/1987 Hanula ..... 213/67 R

FOREIGN PATENT DOCUMENTS

CN 201494461 U 6/2010
CN 101962025 A 2/2011
FR 2 264 697 A1 10/1975

OTHER PUBLICATIONS

International Search Report of International Application No. PCT/CN2011/074764, dated Sep. 29, 2011.

Australian Patent Examination Report No. 1 of corresponding Australian Application No. 2011359051, dated on Sep. 27, 2013.

Canadian Examination Report of Canadian Application No. 2,785,967, dated on Dec. 18, 2013.

* cited by examiner

*Primary Examiner* — Zachary Kuhfuss
(74) *Attorney, Agent, or Firm* — J.C. Patents

(57) ABSTRACT

A coupler yoke and a coupler draft gear are used in the field of carriages of a railway and aim at solving the problems of lower strength, low safety and reliability and the like in the prior art. The coupler yoke comprises a hollow yoke body with the cross section being in a long concentric-square shape, the inner side surface of the one end of the hollow yoke body is a bearing surface, and at least part of the heavy loading area of the bearing surface protrudes outwards relatively to the end surface of the light loading area. The coupler yoke is used for connecting couplers between the carriages of a train, so that the carriages are connected to form the train for transmitting the tractive force in the transportation; the distribution pattern of the existing bearing surface is changed due to the arrangement of a middle groove.

4 Claims, 8 Drawing Sheets

COUPLER YOKE AND COUPLER DRAFT GEAR

CROSS-REFERENCE TO RELATED APPLICATIONS

This application is a continuation of International Application No. PCT/CN2011/074764, filed on May 27, 2011, which claims the priority benefit of China Patent Application No. 201110082265.7, filed on Apr. 1, 2011. The contents of the above identified applications are incorporated herein by reference in their entirety.

FIELD OF THE TECHNOLOGY

The present invention relates to a wagon connecting device, in particular to a coupler yoke and a coupler draft gear that are used for connecting couplers of railway carriages.

BACKGROUND

In the prior art, a coupler draft gear used in railway carriages includes two kinds such as a fixed coupler draft gear and a rotatable coupler draft gear, and a coupler yoke is the most important part of the coupler draft gear. The railway carriages are connected by a coupler, and the coupler is connected with the coupler yoke by a coupler yoke key, so that the connection between the wagons of a train is ensured, and the wagons constitute the train for transmitting tractive force in transportation. There are two kinds of coupler yokes, one is a fixed forged coupler yoke, and the other one is a rotary forged coupler yoke. The fixed coupler draft gear draft gear adopts the fixed coupler yoke, as shown in FIG. 1, the coupler 11 is connected with a draft gear 15 in the fixed coupler yoke 14 by a follower 13, a coupler yoke pin 12 is penetrated between the coupler 11 and the fixed coupler yoke 14 to connect the coupler 11 and the fixed coupler yoke 14, and an inner end surface of the fixed coupler yoke 14, which is in contact with a bottom surface of the buffer 15, is a bearing surface. The rotatable coupler draft gear draft gear adopts the rotatable coupler yoke, as shown in FIG. 2, the coupler 21 is connected with a buffer 25 in the rotary coupler yoke 24 by a follower 23, a coupler yoke shaft 22 is penetrated between the coupler 21 and the rotatable coupler yoke 24 to connect the coupler 21 and the rotatable coupler yoke 24, and an inner end surface of the rotatable coupler yoke 24, which is in contact with a bottom surface of the buffer 25, is a bearing surface. The coupler yokes mainly bear traction loads in use. Both the bearing surfaces 10 of the fixed coupler yoke 14 and the rotatable coupler yoke 24 are the flat surfaces, as shown in FIG. 3 and FIG. 4, the structure is weak in local strength, therefore, the crack and the fracture on the coupler yokes used for the railway wagons are increased obviously along with the acceleration of the running speed and the traction tonnage of the railway carriages, thereby affecting the transportation efficiency and the travelling safety seriously.

SUMMARY

The present invention provides a coupler yoke which is used for solving the defect in the prior art, so that the structural strength, the safety and the reliability of the coupler yoke are effectively improved.

One embodiment of the invention provides a coupler yoke which comprises a hollow yoke body with a cross section being in a long concentric-square shape, an inner end surface of one end of the hollow yoke body is a bearing surface used for bearing a load, the bearing surface comprises a heavy loading area and a light loading area, the heavy loading area can ensure that the coupler yoke bears the load with larger strength compared with the light loading area, wherein the light loading area comprises a middle area and an edge area of the bearing surface, the heavy loading area is located between the middle area and the edge area of the bearing surface, and at least one part of the heavy loading area protrudes outwards relatively to the end surface of the light loading area.

The other embodiment of the invention provides a coupler draft gear which comprises a coupler, a coupler yoke and a buffer, wherein the buffer is arranged in the coupler yoke, a follower is arranged between the coupler and the buffer, a coupler yoke shaft is penetrated between the coupler and the coupler yoke, the coupler yoke comprises the hollow yoke body with the cross section being in a long concentric-square shape, the inner end surface of one end of the hollow yoke body is a bearing surface used for bearing the load, the bearing surface comprises a heavy loading area and a light loading area, the heavy loading area can ensure that the coupler yoke bears the load with larger intensity compared with the light loading area, wherein the light loading area comprises a middle area and an edge area of the bearing surface, the heavy loading area is located between the middle area and the edge area of the bearing surface, and at least one part of the heavy loading area protrudes outwards relatively to the end surface of the light loading area.

For the coupler yoke and the coupler draft gear provided in the invention, as the bearing surface is divided into the heavy loading area and the light loading area, the heavy loading area can bear the load with larger strength, the light loading area can bear the load with relatively low strength, in other words, it is more reasonably that the force is distributed on the heavy loading area rather than on the light loading area of the coupler yoke, and the force acted on the light loading area and other critical areas of the coupler yoke is much smaller, therefore, when the load exerted on the whole bearing surface is uniformly distributed and is not distinguished, and the load is larger than the bearing limit of the light loading area in the using process, the light loading area or the other critical areas of the coupler yoke is/are deformed and even cracked firstly, so as to cause the damage to the whole bearing surface or the other critical areas of the coupler yoke. The shapes and the distribution of the heavy loading area and the light loading area depend on the shape and the structure of the bearing surface. The bearing surface is divided into the heavy loading area and the light loading area, and the end surface of the heavy loading area protrudes outwards relatively to the light loading area, therefore, when the bearing surface is impacted by the bottom surface of the buffer, the heavy loading area bears the larger impact load as end surface of the heavy loading area protrudes, and the light loading area bears the smaller impact load as the light loading area is sunken. The distribution pattern and the shape of the existing bearing surface can be changed due to the structure of the bearing surface, so that the middle part with weak anti-bending, anti-deformed capability and the stress-concentrated edge area are separated from the bottom surface of the buffer to reduce the load force born on the middle part and the edge area. Due to the change of the force distribution, the strength of the weak part of a yoke plate at the tail part is improved, the crack and the fracture on the coupler yoke can be reduced when the coupler yoke is in use, the connecting reliability and the travelling safety of a train are guaranteed, and the exchangeability between the coupler yoke in the invention and the existing coupler yoke can be ensured.

DRAWING MARKS

| | | | | | |
|---|---|---|---|---|---|
| 11 | coupler | 12 | coupler yoke shaft | 13 | follower |
| 14 | fixed coupler yoke | 15 | buffer | 21 | coupler |
| 22 | coupler yoke shaft | 23 | follower | 24 | rotary coupler yoke |
| 25 | buffer | 10 | bearing surface | 31 | coupler |
| 32 | coupler yoke shaft | 33 | follower | 34 | coupler yoke |
| 35 | buffer | 1 | hollow yoke body | 2 | bearing surface |
| 3 | shaft hole | 20 | middle groove | 30 | upper groove |
| 40 | lower groove | 01 | upper part | 02 | lower part |
| 50 | inclined surface | 60 | bearing plate | 011 | bearing surface |
| 012 | bearing surface | 021 | bearing surface | 022 | bearing surface |
| 61 | bearing-plate outer end surface | 70 | bearing plate | 71 | bearing-plate outer end surface |
| 80 | bearing plate | 81 | bearing-plate outer end surface | | |

DETAILED DESCRIPTION

In order to make the objectives, technical solutions, and advantages of the embodiments of the present invention more comprehensible, the technical solutions in the embodiments of the present invention are hereinafter described clearly and completely with reference to the accompanying drawings in the embodiments of the present invention. It is evident that the described embodiments are only part of the embodiments of the present invention, but not all of the embodiments. Other embodiments that those of ordinary skills in the art obtain based on the embodiments of the present invention without creative efforts are all within the protection scope of the present invention.

Embodiment 1

Figure 1:
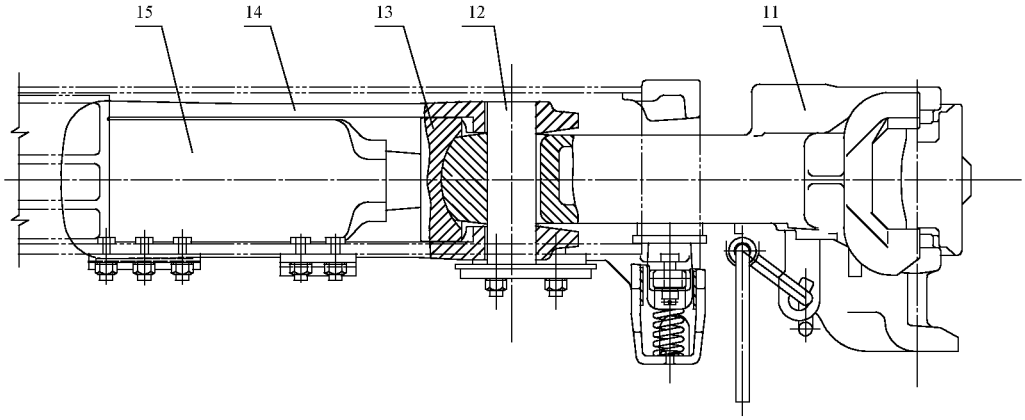
FIG. 1 is a schematic diagram of a fixed coupler draft gear in the prior art.
Figure 2:
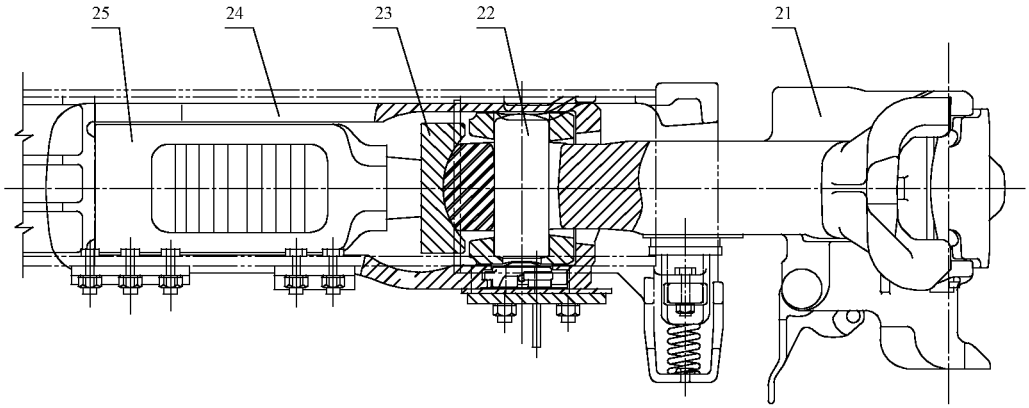
FIG. 2 is a schematic diagram of a rotatable coupler draft gear in the prior art.
Figure 3:
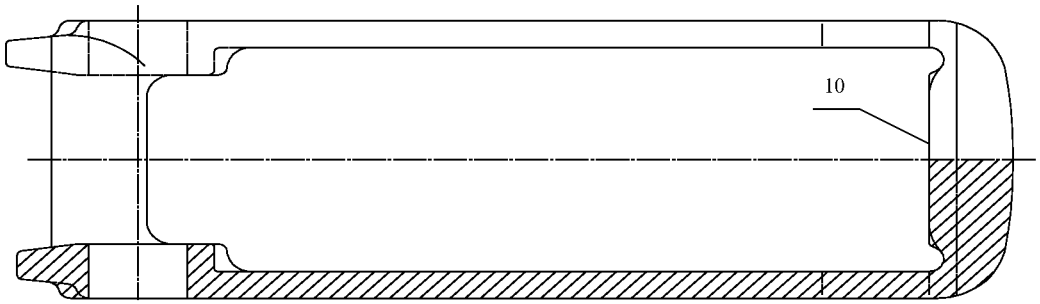
FIG. 3 is a front-view schematic diagram of a coupler yoke in the prior art.
Figure 4:
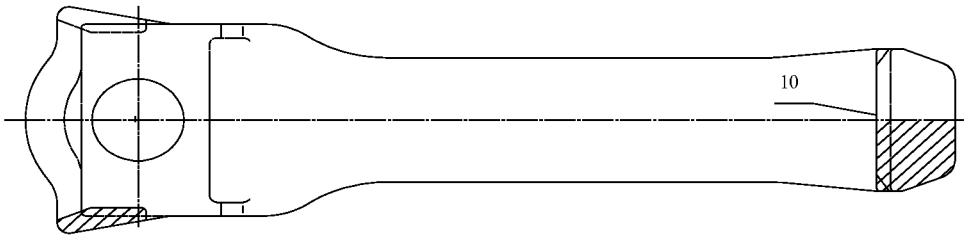
FIG. 4 is a top-view schematic diagram of FIG. 3.
Figure 5:
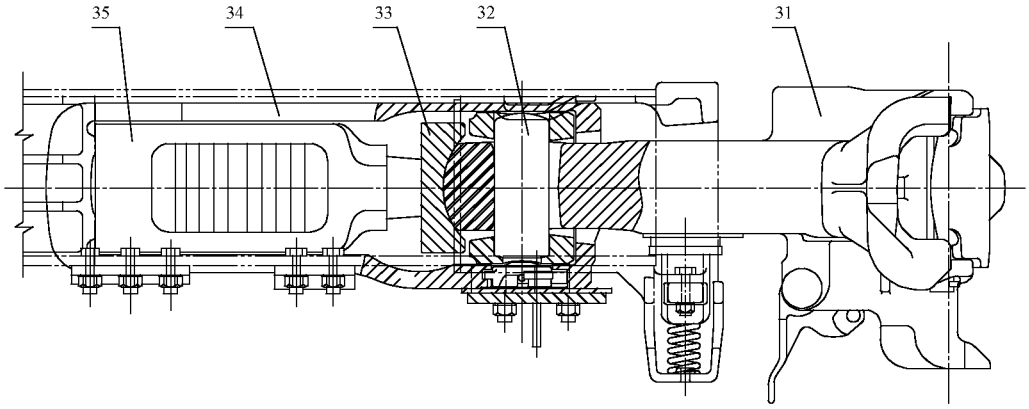
FIG. 5 is a schematic diagram of a coupler draft gear according to an embodiment of the invention.
Figure 6:
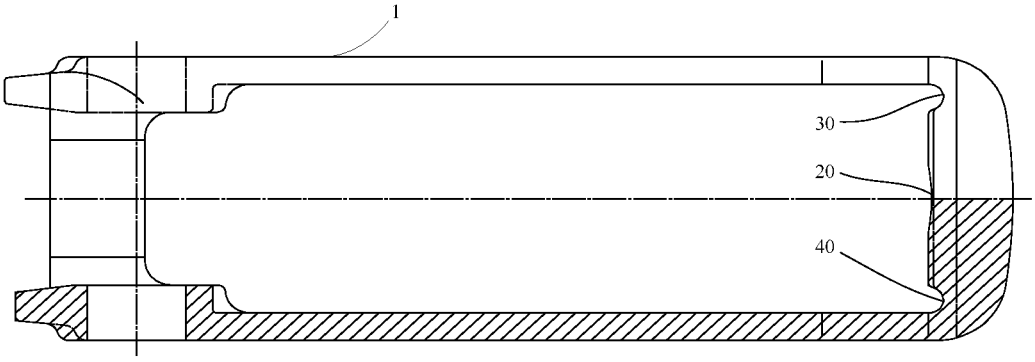
FIG. 6 is a front-view schematic diagram of a coupler yoke according to Embodiment 1 of the invention.
Figure 7:
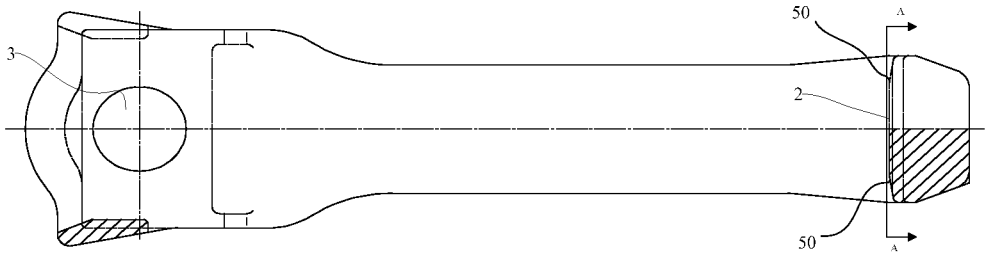
FIG. 7 is a top-view schematic diagram of FIG. 6.
Figure 8:
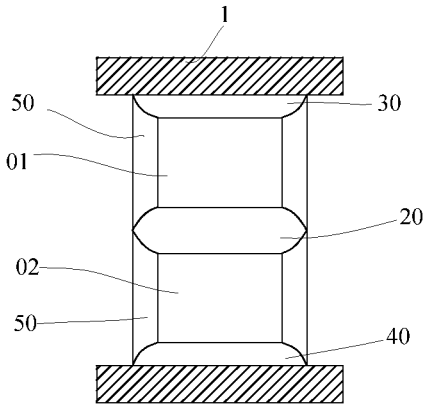
FIG. 8 is a sectional-view schematic diagram along A-A direction in FIG. 6.

As shown in FIG. 5, a coupler draft gear in the invention specifically comprises a coupler 31, a coupler yoke 34 and a buffer 35 that is arranged in the coupler yoke 34, wherein a slave plate 33 is arranged between the coupler 31 and the buffer 35, and a coupler yoke shaft 32 is penetrated between the coupler 31 and the coupler yoke shaft 32. The specific embodiment of the coupler yoke 34 is shown in FIGS. 6-8, wherein the coupler yoke 34 comprises a hollow yoke body 1 with the cross section being in a long concentric-square shape, an inner side surface of one end of the hollow yoke body is a bearing surface 2; at the other end of the hollow yoke body, opposite to the bearing surface 2, an upper side surface and a lower side surface are provided with shaft holes 3 correspondingly, and the coupler yoke shaft used for connecting the coupler yoke and the coupler penetrates through the shaft holes 3. The bearing surface 2 comprises a heavy loading area and a light loading area, and the shapes and the distribution of the heavy loading area and the light loading area depend on the shape and the structure of the bearing surface. The heavy loading area can bear a load with larger strength compared with the light loading area. The light loading area comprises a middle area and an edge area of the bearing surface, and the heavy loading area is located between the middle area and the edge area of the bearing surface. At least one part of the heavy loading area protrudes outwards relatively to the end surface of the light loading area. The middle area comprises a transverse stripe area and/or a longitudinal stripe area, wherein the transverse stripe area is distributed along a width center line of the bearing surface towards two sides of the width center line, and the longitudinal stripe area is distributed along a length center line of the bearing surface towards two sides of the length center line. The middle area also comprises a closed area which is distributed all around by taking an intersection of the width center line and the length center line of the bearing surface as a center. The edge area comprises an upper edge area and a lower edge area of the bearing surface and/or a left edge area and a right edge area of the bearing surface.

The bearing surface is in an integrated structure, wherein the light loading area is shaped like a Chinese character '三' and comprises the upper edge area, the lower edge area and the transverse stripe area of the bearing surface, and the transverse stripe area is located between the upper edge area and the lower edge area. There are three grooves in the light loading area, wherein a middle groove 20 is arranged at the middle part (belonging to the light loading area and corresponding to the transverse stripe area in the middle area) of the bearing surface 2, and the length direction of the middle groove 20 is consistent with that of the hollow yoke body. The bearing surface 2 is divided into an upper part 01 and a lower part 02 by the middle groove 20 An upper end of the upper part 01 of the bearing surface 2, is the stress-concentrated area and has weak anti-bending and anti-deformed capability due to the intersection with the upper side surface of the coupler yoke, and belongs to the light loading area and corresponds to the upper edge area of the bearing surface 2. A lower end of the lower part 02 of the bearing surface 2 is the stress-concentrated area and has weak anti-bending and anti-deformed capability due to the intersection with the lower side surface of the coupler yoke, and belongs to the light loading area and corresponds to the lower edge area of the bearing surface 2. The upper end of the upper part 01 of the bearing surface 2 and the lower end of the lower part 02 of the bearing surface 2 are provided with an upper groove 30 and a lower groove 40 respectively. The upper part 01 and the lower part 02 of the bearing surface protrude outwards relatively to the end surface of the light loading area to form the heavy loading area.

The inner wall surfaces of the middle groove 20, the upper groove 30 and the lower groove 40 are all thinner than the bearing surface 2, therefore, the inner wall surfaces of the middle groove 20, the upper groove 30 and the lower groove 40 are not in contact with the bottom surface of the buffer in the using process, thereby preventing the middle part, the upper edge area and the lower edge area of the bearing surface from being bended and deformed or cracked and fractured due to the larger force and changing the distribution pattern of the bearing surface 2, so as to change the distribution of the force and avoid the situation that the service life of the coupler yoke is affected as the local strength of the bearing surface 2 is weak. The middle groove 20, the upper groove 30 and the lower groove 40 can be in a U shape, a V shape, a semi-circle shape, an arc shape, a trapezoid or other irregular shapes and are not limited in the invention.

According to a preferred embodiment of the invention, the light loading area of the coupler yoke is in a '日' shape and comprises left edge areas and right edge areas of the upper part and the lower part of the bearing surface. The left edge area and the right edge area of the bearing surface are respectively provided with inclined surfaces 50. Specifically, two sides (i.e., the edge areas, belonging to the light loading area and corresponding to the left edge areas and the right edge areas of the bearing surface) of the upper part 01 of the bearing surface 2 and the lower part 02 of the bearing surface 2 are respectively provided with the inclined surfaces 50, wherein the inclined surfaces 50 are inclined inwards relatively to the bearing surface 2, namely, the inclined surfaces 50 are sunken inwards relatively to the bearing surface 2. The two sides of the upper part 01 and the lower part 02 of the bearing surface are separated from the bottom surface of the buffer due to the arrangement of the inclined surfaces 50, thereby preventing the two sides of the edges from being cracked and fractured due to the larger force in the using process as the strength is lower. The upper part 01 of the bearing surface 2 and the inclined surfaces 50 at the two sides of the upper part 01 are arranged between the upper groove 30 and the middle groove 20, and the lower part 02 of the bearing surface 2 and the inclined surfaces 50 at the two sides of the lower part 02 are arranged between the middle groove 20 and the lower groove 40. The upper groove, the middle groove and the inclined surfaces between the upper groove and the middle groove are connected end to end to form an upper annular concave stripe, the lower groove, the middle groove and the inclined surfaces between the lower groove and the middle groove constitute a lower annular concave stripe, and the bearing surface encircled by the upper annular concave stripe and the lower annular concave stripe protrudes outwards relatively to the end surface of the light loading area. The upper part and the lower part of the bearing surface are encircled respectively by the upper annular concave stripe area and the lower annular concave stripe area, the four corners of the upper annular concave stripe area and the four corners of the lower annular concave stripe area are the stress-concentrated areas, and other parts of the upper annular concave stripe area and the lower annular concave stripe area are the areas with weak strength, therefore, the stress states of the two annular concave stripe areas can affect the overall structure of the coupler yoke, and the two annular concave stripe areas are the critical parts. In the structure of the invention, the inner wall surfaces of the two annular concave stripe areas are all thinner than the bearing surface, therefore, the two annular concave stripe areas are separated from the bottom surface of the buffer in the using process, the stress at the two annular concave stripe areas is relatively small, so that most load force is acted on the upper part and the lower part with higher strength, and the force distribution of the bearing surface is changed. The overall strength, the safety and the reliability of the coupler yoke are improved as the stress at the areas with lower strength is reduced.

Embodiment 2

Figure 9:
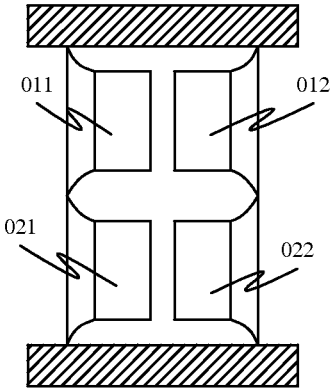
FIG. 9 is a front-view schematic diagram of a coupler yoke according to Embodiment 2 of the invention.

As shown in FIG. 9, a light loading area according to a modified embodiment of Embodiment 1 is in a grid shape and also comprises a longitudinal area based on the '田' shape. A middle groove 20 is arranged in the longitudinal area and runs through an upper annular concave stripe and a lower annular concave stripe up and down, so that the upper annular concave stripe is divided into an upper left annular concave stripe and an upper right annular concave stripe, and the lower annular concave stripe is divided into a lower left annular concave stripe and a lower right annular concave stripe. A bearing surface 011 encircled by the upper left annular concave stripe, a bearing surface 012 encircled by the upper right annular concave stripe, a bearing surface 021 encircled by the lower left annular concave stripe and a bearing surface 022 encircled by the lower right annular concave stripe protrude outwards relatively to the end surface of the light loading area to form a heavy loading area.

Transverse grooves running along with the direction being consistent with the middle groove 20 shown in FIG. 8 are arranged in the light loading areas of an upper part 01 and a lower part 02, and/or longitudinal grooves in the direction being vertical to the middle groove 20 shown in FIG. 8 are arranged in the light loading areas of the upper part 01 and the lower part 02, and/or pits are arranged in the light loading areas of the upper part 01 and the lower part 02, so that the end surfaces of the light loading areas on the upper part and the lower part of the bearing surface are sunken inwards relatively to the bearing surfaces at the other parts, and the light loading areas on the upper part 01 and the lower part 02 are prevented from being in contact with the bottom surface of a buffer in the using process, so as to reduce the load force on the light loading areas.

In the embodiment, the inner wall surfaces of an upper groove 30, a lower groove 40 and the middle groove 20 are all cambered surfaces including regular geometry cambered surfaces such as arc surfaces and ellipse cambered surface or other irregular cambered surfaces. The radian radius of the inner wall surface of the upper groove 30 is approximately equal to that of the inner wall surface of the lower groove 40 and is less than that of the inner wall surface of the middle groove 20. Therefore, the overall tensile strength and compressive strength of the tail part of a coupler yoke can be improved, and the stability and the reliability of the structure can be enhanced.

The height of the upper groove 30 is approximately equal to that of the lower groove 40 and is more than that of the middle groove 20, or the width of the upper groove 30 is approximately equal to that of the lower groove 40 and is less than that of the middle groove 20. The shape and the size of the bearing surface are set according to the load distribution in the using process so as to greatly improve the overall structural strength of the coupler yoke. For the same raw material with the same quantity, the coupler yoke of the embodiment saves material compared with the existing coupler yoke having increased wall thickness for enhancing the strength. Meanwhile, the coupler yoke of the embodiment has longer fatigue life, so as to adapt to the requirement on the development of heavy transportation of a railway. The structure of the coupler yoke in the invention is not only suitable for being manufactured through a forging process, but also suitable for being manufactured through a foundry process. The coupler yoke can adapt to the requirements on the continuous increase of the running speed and the traction tonnage of trucks in the railway, reduce the crack and the fracture in the using process and lower the application and overhaul workload and the application and overhaul cost. As the operation mode and the action principle of the existing coupler draft gear are not changed, the coupler yoke can directly replace the existing coupler yoke of the carriages of the railway.

Embodiment 3

Figure 10:
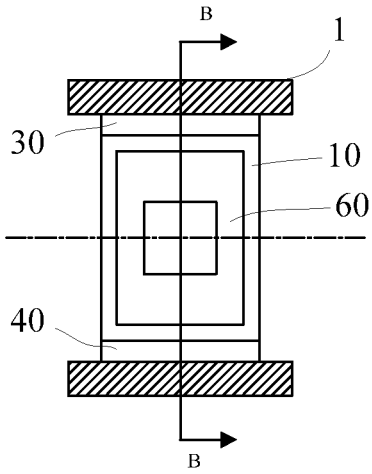
FIG. 10 is a partial front-view schematic diagram of a coupler yoke according to Embodiment 3 of the invention.
Figure 11:
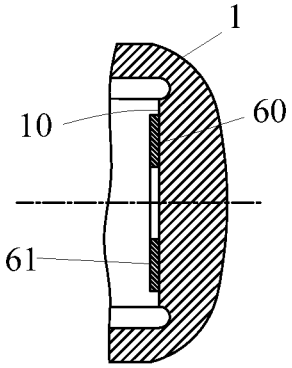
FIG. 11 is a sectional-view schematic diagram along B-B direction in FIG. 10.

As shown in FIG. 10 and FIG. 11, a bearing surface is in a combined structure, an upper groove 30 and a lower groove 40 are arranged on a light loading area of the bearing surface 10 of a hollow yoke body 1, and a heavy loading area is in an annular shape. A bearing plate 60 is fixedly arranged in the heavy loading area of the bearing surface between the upper groove 30 and the lower groove 40 in a connection mode such as a welding mode, a riveting mode, a bonding mode or a bolting mode. The bearing plate 60 is in an annular shape, specifically, as shown in the figures, the bearing plate 60 is in a square-annular shape and it also can be in a ring shape, an elliptical ring shape, a rectangle, a circle or other geometric shapes, and the shape of the bearing plate is not limited and is in a circumferentially symmetrical shape optimally. A hollow part of the bearing plate 60 corresponds to the center area (the light loading area) of the bearing surface, and gaps are left between the edge of the bearing plate 60 and the upper groove 30, between the edge of the bearing plate 60 and the lower groove 40 as well as between the edges of the bearing plate 60 and the left and right sides of the bearing surface. The outer end surface 61 of the bearing plate protrudes outwards relatively to the bearing surface to form the heavy loading area. The heavy loading area is in contact with the bottom of the buffer in the hollow yoke body in the using process, and the heavy loading area can bear a load with larger strength. As the heavy loading area is located between the center and the edge of the bearing surface, the part between the center and the edge of the bearing surface can just bear relatively larger strength than the center and the edge of the bearing surface and can not be deformed easily, therefore, the strength of the hollow yoke body can be enhanced wholly due to the structure.

Embodiment 4

Figure 12:
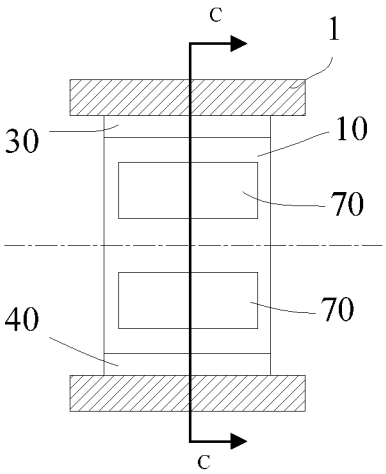
FIG. 12 is a partial front-view schematic diagram of a coupler yoke according to Embodiment 4 of the invention.
Figure 13:
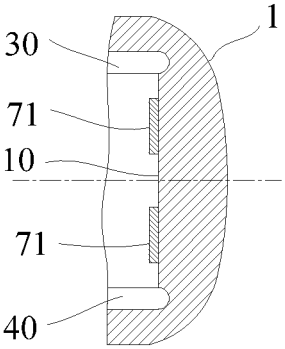
FIG. 13 is a sectional-view schematic diagram along C-C direction in FIG. 12.

As shown in FIG. 12 and FIG. 13, two bearing plates 70 are arranged on a bearing surface 10 of a hollow yoke body 1 and are respectively arranged at the two sides (the upper side and the lower side) of a transverse stripe area of the bearing surface 10. In the structure, a light loading area comprises an upper edge area, a lower edge area, a left edge area, a right edge area and the transverse stripe area, and the light loading area is in a '日' shape so that the bearing surface is divided into an upper half part and a lower half part, heavy loading areas are located on the upper half part and the lower half part, and the bearing plates are respectively arranged on the heavy loading areas on the upper half part and the lower half part. The bearing plates are arranged in parallel and are symmetrical along the transverse stripe area. The force on the bearing plates is balanced. As the outer end surfaces 71 of the two bearing plates protrude outwards relatively to the bearing surface 10, the outer end surfaces of the two bearing plates are in contact with the bottom surface of a buffer to bear a heavy load in the using process.

Embodiment 5

Figure 14:
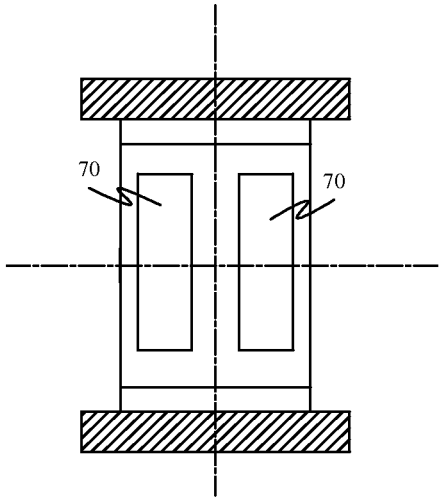
FIG. 14 is a partial front-view schematic diagram of a coupler yoke according to Embodiment 5 of the invention.

As a modified embodiment of Embodiment 4, two bearing plates 70 are arranged on a bearing surface 10 of a hollow yoke body 1 and are respectively arranged at the two sides (the left side and the right side) of a transverse stripe area of the bearing surface 10. As shown in FIG. 14, in the structure, a light loading area comprises an upper edge area, a lower edge area and a longitudinal stripe area, and the light loading area is in a "工" shape so that the bearing surface is divided into a left half part and a right half part. Heavy loading areas are located on the left half part and the right half part, and the bearing plates 70 are respectively arranged on the heavy loading areas in the left half part and the right half part. The bearing plates are arranged in parallel and are symmetrical along the longitudinal stripe area. The force on the bearing plates is balanced. In addition, the two bearing plates are symmetrical at the upper left side and the right lower side or at other symmetrical positions with respect to the center area of the bearing surface. The two bearing plates are arranged in parallel and are symmetrical along the center area of the bearing surface.

Embodiment 6

Figure 15:
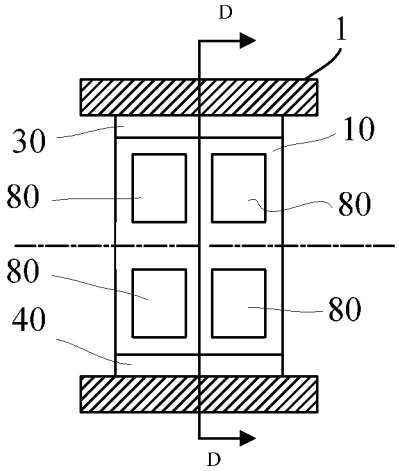
FIG. 15 is a partial front-view schematic diagram of a coupler yoke according to Embodiment 6 of the invention.
Figure 16:
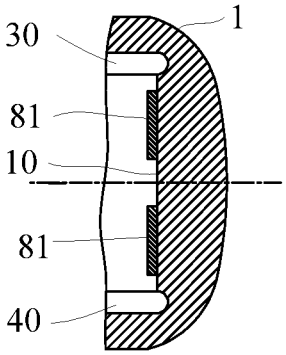
FIG. 16 is a sectional-view schematic diagram along D-D direction in FIG. 15.

As shown in FIG. 15 and FIG. 16, a light loading area comprises an upper edge area, a lower edge area, a left edge area, a right edge area, a transverse stripe area and a longitudinal stripe area. The light loading area is in a '田' shape so that the bearing surface is divided into an upper left half part, an upper right half part, a lower left half part and a lower right half part. Heavy loading areas are located on the upper left half part, the upper right half part, the lower left half part and the lower right half part. Four bearing plates 80 are arranged on the bearing surface 10 of a hollow yoke body 1, and the bearing plates 80 are distributed in a "田" shape and are respectively arranged on the heavy loading areas on the upper left half part, the upper right half part, the lower left half part and the lower right half part. The bearing plates are arranged in parallel and are symmetrical along the transverse stripe area and the longitudinal stripe area. As the outer end surfaces 81 of the bearing plates protrude outwards relatively to the bearing surface 10, the outer end surfaces of the bearing plates are in contact with the bottom surface of a buffer to bear a heavy load in the using process.

In Embodiment 2, Embodiment 3 and Embodiment 4, a bearing plate or bearing plates is/are arranged on a bearing surface 10 or bearing surfaces 10, and the outer end surface of the bearing plate or the outer end surfaces of the bearing plates form a convex surface or convex surfaces for bearing a heavy load or heavy loads, so that the stress position of the bearing surface(s) is changed. In Embodiment 1, grooves or pits are arranged on the bearing surface, the inner side surfaces of the grooves or the pits form concave surfaces for bearing lighter loads. The shapes including regular shapes such as circle, ellipse, rectangle, triangle, polygon or other irregular shapes and the number of the bearing plate(s) and the pits or the grooves are not limited by the above embodiments, and the combined distribution of the bearing plates and the combined distribution of the groove or the pit are not limited by the above embodiments.

Finally, it should be noted that the above embodiments are merely used for describing the technical solutions of the present invention, but not intended to limit the present invention. Although the present invention has been described in detail with reference to the foregoing embodiments, it should be understood that those of ordinary skills in the art can make modifications to the technical solutions recited in the foregoing embodiments or equivalent substitutions of a part of technical features thereof, and these modifications or substitutions do not make the essence of their corresponding technical solutions deviate from the spirit and scope of the technical solutions of the embodiments of the present invention.

What is claimed is:

1. A coupler yoke, comprising a hollow yoke body with a cross section being in a long concentric-square shape, wherein an inner side surface of one end of the hollow yoke body is a bearing surface used for bearing a load, wherein the bearing surface comprises a heavy loading area and a light loading area, the heavy loading area bears a load with larger strength compared with the light loading area, wherein the light loading area is located in a middle area and an edge area of the bearing surface, the heavy loading area is located between the middle area and the edge area of the bearing surface, and at least one part of the heavy loading area protrudes outwards relatively to an end surface of the light loading area, wherein the middle area comprises a transverse stripe area and a longitudinal stripe area, the transverse stripe area is distributed along a width center line of the bearing surface towards two sides of the width center line, and the longitudinal stripe area is distributed along a length center line of the bearing surface towards two sides of the length center line; and the edge area comprises an upper edge area, a lower edge area, a left edge area and a right edge area of the bearing surface, the bearing surface is in an integrated structure, the light loading area comprises the upper edge area, the lower edge area, the left edge area and the right edge area, the transverse stripe area and the longitudinal stripe area of the bearing surface, the light loading area is in a "田" shape, the left edge area and the right edge area of the bearing surface are respectively provided with the inclined surfaces, grooves are respectively arranged in the longitudinal stripe area, transverse stripe area, upper edge area and lower edge area of the light loading area, wherein the grooves in the upper edge area and the transverse stripe area as well as the inclined surfaces between the two grooves are connected end to end to form an upper annular concave stripe, the grooves in the lower edge area and the transverse stripe area as well as the inclined surfaces between the two grooves are connected end to end to form a lower annular concave stripe, and the grooves in the longitudinal stripe area runs through the upper annular concave stripe and the lower annular concave stripe, so that the upper annular concave stripe is divided into an upper left annular concave stripe and an upper right annular concave stripe, and the lower annular concave stripe is divided into a lower left annular concave stripe and a lower right annular concave stripe; and the heavy loading area is formed on the bearing surface encircled by the upper left annular concave stripe, the upper right annular concave stripe, the lower left annular concave stripe and the lower right annular concave stripe, and the heavy loading area protrudes outwards relatively to the end surface of the light loading area.

2. A coupler draft gear, comprising: a coupler, a coupler yoke and a buffer which is arranged in the coupler yoke, wherein a slave plate is arranged between the coupler and the buffer, and a coupler yoke shaft is penetrated between the coupler and the coupler yoke; wherein the coupler yoke is any one of the coupler yokes described in the above claim 1.

3. A coupler yoke, comprising a hollow yoke body with a cross section being in a long concentric-square shape, wherein an inner side surface of one end of the hollow yoke body is a bearing surface used for bearing a load, wherein the bearing surface comprises a heavy loading area and a light loading area, the heavy loading area bears a load with larger strength compared with the light loading area, wherein the light loading area is located in a middle area and an edge area of the bearing surface, the heavy loading area is located between the middle area and the edge area of the bearing surface, and at least one part of the heavy loading area protrudes outwards relatively to an end surface of the light loading area, wherein the middle area comprises a transverse stripe area and a longitudinal stripe area, the transverse stripe area is distributed along a width center line of the bearing surface towards two sides of the width center line, and the longitudinal stripe area is distributed along a length center line of the bearing surface towards two sides of the length center line; and the edge area comprises an upper edge area, a lower edge area, a left edge area and a right edge area of the bearing surface, the bearing surface is in a combined structure, the light loading area comprises the upper edge area, the lower edge area, the left edge area, the right edge area, the transverse stripe area and the longitudinal stripe area, the light loading area is in a "田" shape so that the bearing surface is divided into an upper left half part, an upper right half part, a lower left half part and a lower right half part, heavy loading areas are located on the upper left half part, the upper right half part, the lower left half part and the lower right half part, and bearing plates are respectively arranged on the heavy loading areas on the upper left half part, the upper right half part, the lower left half part and the lower right half part.

4. The coupler yoke according to claim 3, characterized in that: the bearing plates are arranged in parallel and are symmetrical along the transverse stripe area and the longitudinal stripe area.

* * * * *